US005887901A

United States Patent [19]

Ohmiya

[11] Patent Number: 5,887,901

[45] Date of Patent: Mar. 30, 1999

[54] DETACHABLE METAL BINDER AND FILE WITH THE DETACHABLE METAL BINDER

[75] Inventor: Tokusige Ohmiya, Tokyo, Japan

[73] Assignee: King Jim Co., Ltd., Tokyo, Japan

[21] Appl. No.: 875,143

[22] PCT Filed: Nov. 21, 1996

[86] PCT No.: PCT/JP96/03421

§ 371 Date: Jul. 21, 1997

§ 102(e) Date: Jul. 21, 1997

[87] PCT Pub. No.: WO97/18956

PCT Pub. Date: May 29, 1997

[30] Foreign Application Priority Data

Nov. 22, 1995 [JP] Japan ..... 7-304712

[51] Int. Cl.[6] ..... B42D 3/00

[52] U.S. Cl. ..... 281/36; 281/21.1; 281/29; 402/73

[58] Field of Search ..... 281/15.1, 21.1, 281/36, 37, 29, 51, 28; 402/73, 46, 36, 26

[56] References Cited

U.S. PATENT DOCUMENTS

| | | | |
|---|---|---|---|
| 1,556,721 | 10/1925 | Schade | 281/36 |
| 3,175,847 | 3/1965 | McKowen | 281/36 |
| 4,730,950 | 3/1988 | Ominato | 402/46 X |
| 5,622,386 | 4/1997 | Young | 281/36 |

FOREIGN PATENT DOCUMENTS

| | | |
|---|---|---|
| 5-46482 | 6/1993 | Japan . |
| 7-07980 | 2/1995 | Japan . |
| WO 9535219 | 12/1995 | WIPO . |

*Primary Examiner*—Willmon Fridie, Jr.
*Attorney, Agent, or Firm*—Edward W. Callan

[57] ABSTRACT

A detachable metal binder designed to be detached from a file when needed by a user and a file having this detachable metal binder. A detachable metal binder in which a bottom plate (20*a*) is mounted on a spine (10*a*) of a cover (10) by means of a connecting pin (14) comprises restricting means (24) provided in each corner of the bottom plate (20*a*), the restricting means comprising a locking hole portion (24*b*) for locking a clamping portion (14*c*) of the connecting pin (14), a passing-through hole (24*c*) through which the clamping portion (14*c*) is allowed to pass, and a guiding opening (24*a*) for establishing a communication between the passing-through hole (24*c*) and the locking hole and allowing the movement of a shaft portion (14*b*) of the connecting pin (14) that connects an extended diameter head portion (14*a*) and the clamping portion (14*c*) thereof. A file comprising a cover (10) and a metal binder adapted to be mounted on a spine (10*a*) of the cover (10) in which the afore-mentioned restricting means (24) is provided in each corner of the bottom plate (20*a*) and in which a restriction opening (15) that allows the clamping portion (14*c*) of the connecting pin (14) to pass therethrough is formed in the spine (10*a*) at positions corresponding to the restricting means (24).

6 Claims, 6 Drawing Sheets

FIG. 1
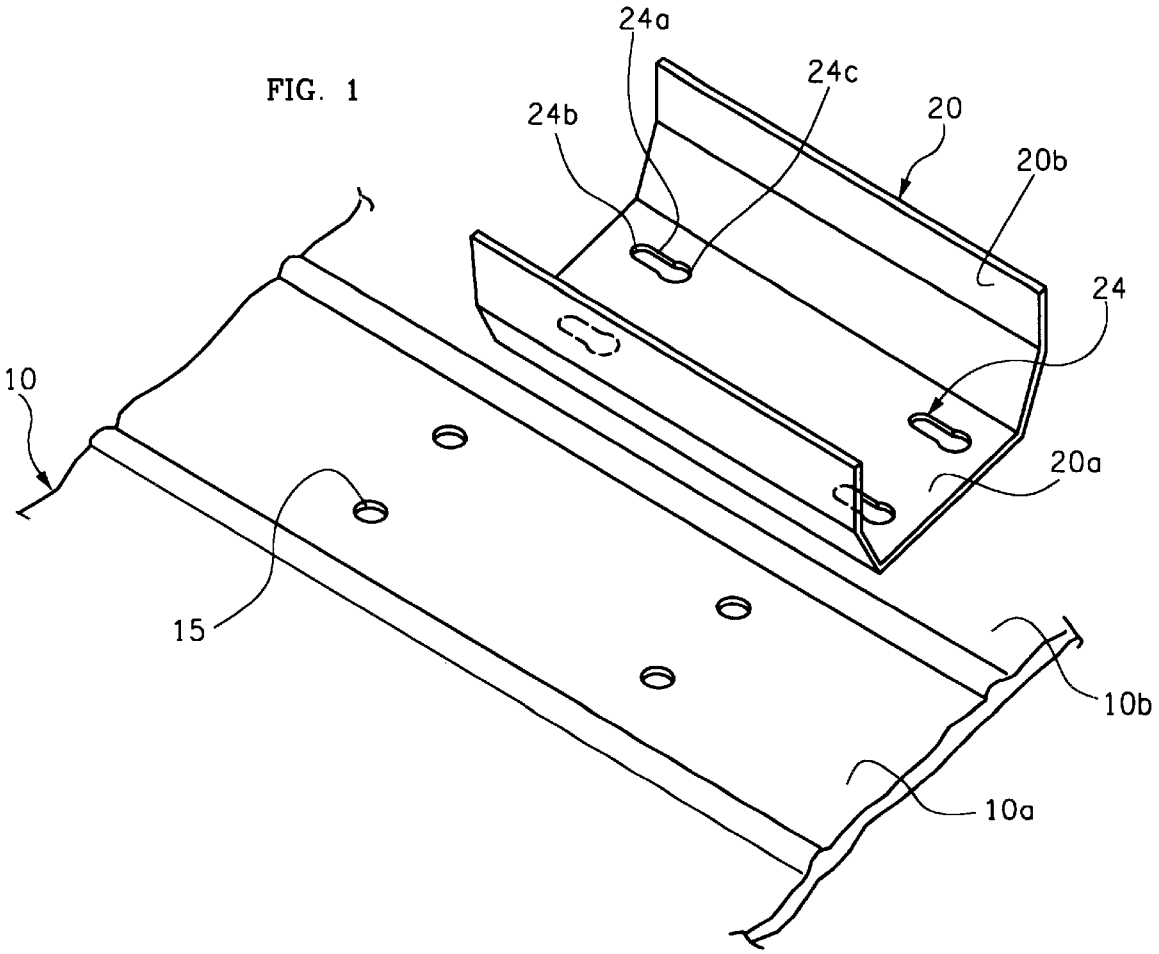
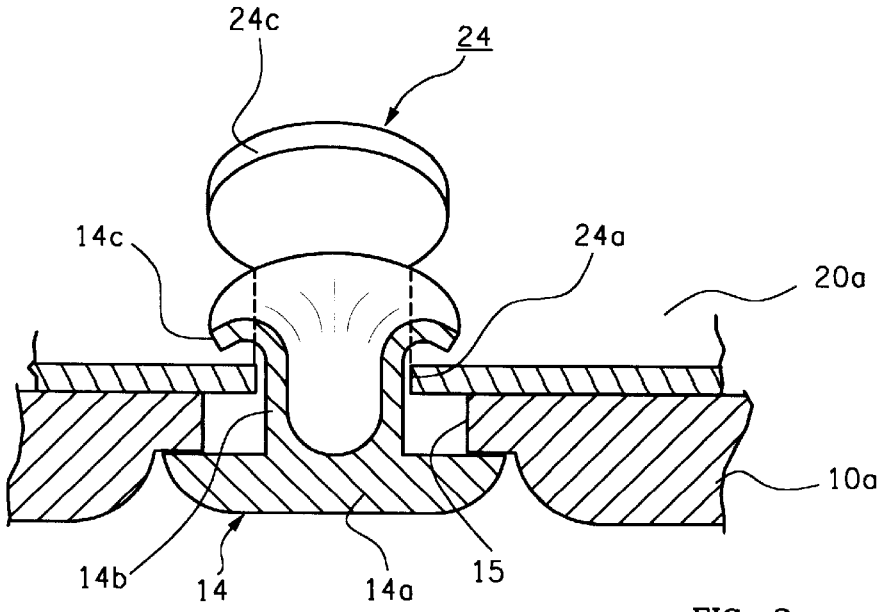
FIG. 2

FIG. 3
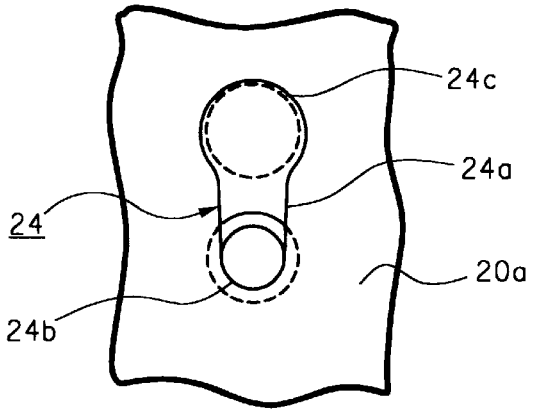
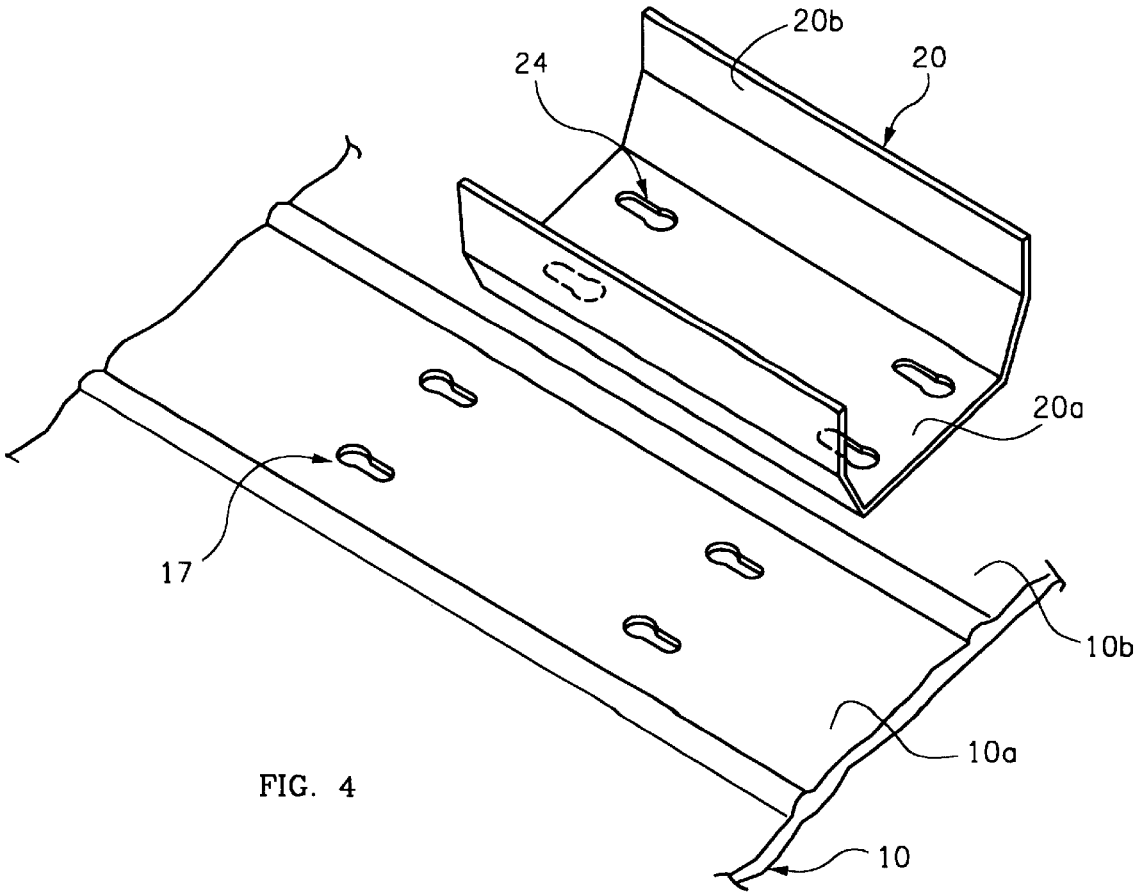
FIG. 4

FIG. 5
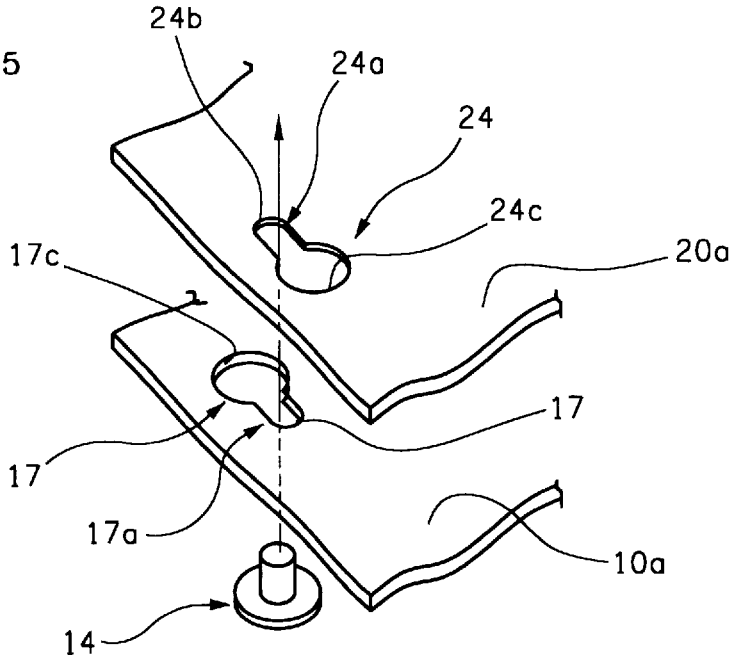
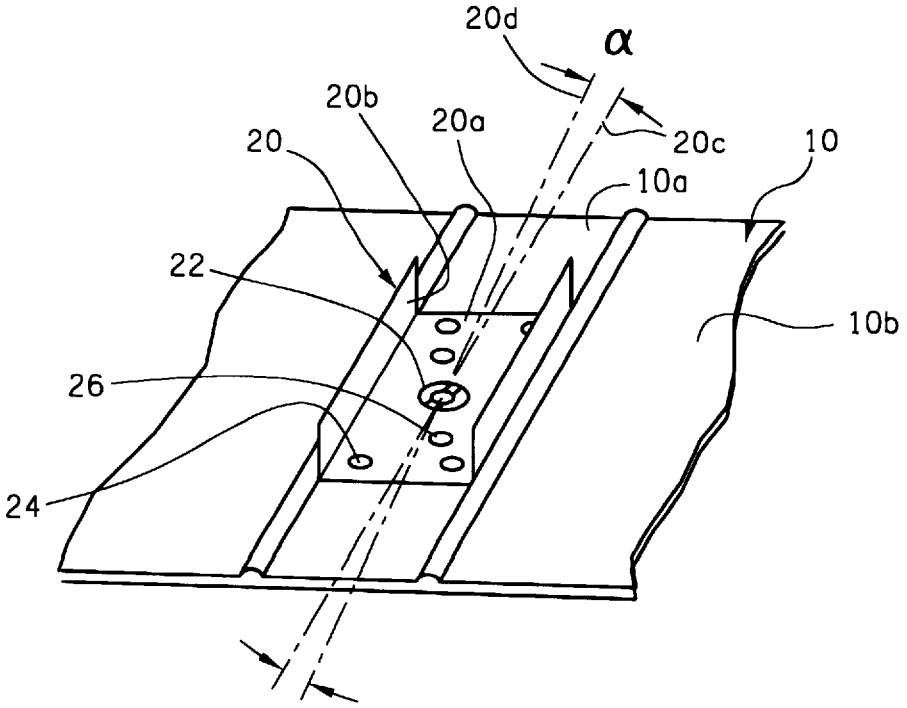
FIG. 6

DETACHABLE METAL BINDER AND FILE WITH THE DETACHABLE METAL BINDER

TECHNICAL FIELD

The present invention relates to a metal binder and a file with the metal binder, and more particularly to a detachable metal binder and a file with the detachable metal binder.

BACKGROUND ART

Generally, a file with a metal binder, as shown in FIG. 6, is comprised of a cover (10) and a metal binder (20), in which a bottom plate (20*a*) of the metal binder (20) is mounted on a spine (10*a*) of the cover (10). In FIG. 6, the referenced symbol, 10*b* indicates a front cover or a back cover of the cover (10), and the referenced symbol, 20*b* indicates a side plate of the metal binder (20), respectively.

In this type of file, both of the cover and the metal binder are made firmly and connected fixedly each other through a connection pin such as a rivet, and it is well-known that this kind of file is broadly used as a file of relatively large capacity.

The conventional file with the metal binder involves, however, the following problems.

Namely, in the conventional file, the cover and the metal binder are made firmly and connected fixedly, but the "fixed connection" has difficulty in a recycling of natural resources for separating (or assorted collection) a file (disposal) into a cover (paper) and a metal binder (metal). Accordingly, the conventional file has been required to be separated into the cover and the metal binder when desired by a user.

The purpose of the present invention is to provide a detachable metal binder designed to be detached from a file when needed by a user, and a file with the detachable metal binder.

DISCLOSURE OF INVENTION

The purpose of the present invention is performed by providing a detachable metal binder in which a bottom plate is mounted on a spine of a cover by means of a connection pin, which is characterized by comprising a restriction means provided in each corner of the bottom plate providing a locking hole portion for locking a clamping portion of the connection pin, a passing-through hole through which the clamping portion is allowed to pass, and a guide-opening for establishing a communication between the passing-through hole and the locking hole and allowing the movement of a shaft portion of the connection pin that connects an extended diameter head portion and the clamping portion thereof, the guide-opening being formed substantially in parallel to a side edge of the bottom plate, and each locking hole portion of the restriction means is formed at a closer position to one of edge portions which are opposed each other in the bottom plate than the passing-through hole communicating with the locking hole portion.

The purpose of the second invention is to provide a detachable metal binder in which a bottom plate is mounted on a spine of a cover by means of a connection pin, which is characterized by comprising a rotation means provided in a center of the bottom plate to rotatably attach the metal binder into the spine, a restriction means provided in each corner of the bottom plate providing a locking hole portion for locking a clamping portion of the connection pin, a passing-through hole through which the clamping portion is allowed to pass, and a guide-opening for establishing a communication between the passing-through hole and the locking hole and allowing the movement of a shaft portion of the connection pin that connects an extended diameter head portion and the clamping portion thereof, and a locking means in which the connection pin for locking the bottom plate in a locking position of the locking hole portion is respectively arranged between the restriction means on one edge of the bottom plate and the rotation means and between the restriction means on the opposite edge of the bottom plate and the rotation means, wherein the guide-opening allows a relative movement of the connection pin and the bottom plate so that the passing-through hole is able to accommodate the connection pin when the bottom plate is rotated by a certain angle from the locking position.

The purpose of the third invention is to provide a file with a detachable metal binder including a cover and a metal binder attached in a spine of the cover, and comprises a connection pin including a shaft portion, an extended diameter head portion formed in one edge of the shaft portion, the clamping portion provided in the opposite edge of the shaft portion, a restriction means provided in each corner of the bottom plate of the metal binder and comprising a locking hole portion for locking a clamping portion of the connection pin, a passing-through hole through which the clamping portion is allowed to pass, and a guide-opening for establishing a communication between the passing-through hole and the locking hole portion and allowing the movement of a shaft portion of the connection pin, and a restriction opening that allows the clamping portion of the connection pin to pass therethrough and is formed in the spine at positions corresponding to the restriction means, wherein the guide-opening, is formed substantially in parallel to a side edge of the bottom plate, and each locking hole portion of the restriction means is formed at a closer position to one of edge portions which are opposed each other in the bottom plate than the passing-through hole communicating with the locking hole portion.

The purpose of the fourth invention is to provide a file with a detachable metal binder including a cover and a metal binder attached in a spine of the cover, and comprises a connection pin providing a shaft portion, an extended diameter head portion formed in one edge of the shaft portion, and a clamping portion provided in connection pin of the shaft portion, a restriction means provided in each corner of the bottom plate of the metal binder and comprising a locking hole portion for locking a clamping portion of the connection pin, a passing-through hole through which the clamping portion is allowed to pass, and a guide-opening for establishing a communication between the passing-through hole and the locking hole portion and allowing the movement of a shaft portion of the connection pin, and a restriction opening being formed in substantially the same shape as the restriction means and provided in the spine at positions corresponding to the restriction means to enable the connection pin to be attached and detached to the spine, wherein the guide-opening is formed substantially in parallel to a side edge of the bottom plate, and each locking hole portion of the restriction means is formed at a closer position to one of edge portions which are opposed each other in the bottom plate than the passing-through hole communicating with the locking hole portion.

The purpose of the fifth invention is to provide a file with a detachable metal binder including a cover and a metal binder attached in a spine of the cover, and comprises a connection pin including a shaft portion, an extended diameter head portion formed in one edge of the shaft portion, and a clamping portion provided in the opposite edge of the shaft portion, a rotation means provided in a center of the bottom plate of the metal binder to rotatably attach the metal binder into the spine, a restriction means provided in each corner of the bottom plate, and consisting of a locking hole portion for locking a clamping portion of the connection pin, a passing-through hole through which the clamping portion is allowed to pass, and a guide-opening for establishing a communication between the passing-through hole and the locking hole and allowing the movement of a shaft portion of the connection pin, and a locking means in which the connection pin for locking the bottom plate in a locking position of the locking hole portion respectively arranged between the restriction means on one edge of the bottom plate and the rotation means and between the restriction means on the opposite edge of the bottom plate and the rotation means, and a restriction opening that allows a clamping portion of the connection pin to pass therethrough and is formed in the spine at positions corresponding to the locking hole portion in which the bottom plate is in the locking position, a circular opening for accommodating the rotation means rotatably and provided in the spine at positions corresponding to the rotation means, and a locking hole for enabling an insertion locking of the locking means and provided in the spine at positions corresponding to the locking means, wherein the guide-opening allows a relative movement of the connection pin and the bottom plate so that the passing-through hole is able to accommodate the connection pin when the bottom plate is rotated by a certain angle from the locking position.

In this situation, the rotation means, the restriction means, and the locking means may possibly be formed respectively by an extruding process, an punching process, and an bending process for the bottom plate.

In the detachable metal binder as defined in claim 1, the locking hole portion of the restriction means locks the clamping portion of the connection pin, the passing-through hole of the restriction means passes the clamping portion, and the guide-opening of the restriction means allows a movement of the connection pin in order to move the metal binder in the parallel direction to the side edge of the bottom plate of the metal binder, and according to this movement, the connection pin is positioned in the passing-through hole.

In the detachable metal binder as defined in claim 2, the rotation means is provided in a center of the bottom plate to attach the metal binder rotatably on the spine, the locking hole portion of the restriction means locks the clamping portion of the connection pin, the passing-through hole of the restriction means passes the clamping portion, and the guide-opening of the restriction means allows the movement of the connection pin in order to enable the passing-through hole to accommodate the connection pin when the bottom plate of the metal binder is rotated by a certain angle from a position of the bottom plate in which the connection pin is locked in the locking hole portion. The locking means locks the bottom plate in a position where the connection pin is locked in the locking hole portion of the restriction means.

In the file with the detachable metal binder as defined in claim 3, the locking hole portion of the restriction means locks the clamping portion of the connection pin, the passing-through hole of the restriction means passes the clamping portion, and the guide-opening of the restriction means allows the movement of the connection pin in order to move the metal binder in the parallel direction to the side edge of the bottom plate of the metal binder, and according to the movement, the connection pin is positioned in the passing-through hole.

In the file with the detachable metal binder as defined in claim 4, the locking hole portion of the restriction means locks the clamping portion of the connection pin, the passing-through hole of the restriction means passes the clamping portion, and the guide-opening of the restriction means allows the movement of the connection pin in order to move the metal binder in the parallel direction to the side edge of the bottom plate of the metal binder, and according to the movement, the connection pin is positioned in the passing-through hole. The restriction opening is formed in substantially the same shape as the restriction means and provided in the spine at positions corresponding to the restriction means to enable the connection pin to be attached and detached to the spine.

In the file with the detachable metal binder as defined in claim 5, the rotation means is attached to the center of the bottom plate to be rotatable on the spine of the metal binder, the locking hole portion of the restriction means locks the clamping portion of the connection pin, the passing-through hole of the restriction means passes the clamping portion, the guide-opening of the restriction means allows the movement of the connection pin in order to enable the passing-through hole to accommodate the connection pin when the bottom plate of the metal binder is rotated by a certain angle from a position of the bottom plate in which the connection pin is locked in the locking hole portion. The locking means locks the bottom plate in a position that the connection pin is locked in the locking hole portion of the restriction means, the restriction opening is provided in the spine at positions corresponding to the locking hole portion when the bottom plate is in the locking position to allow the passing-through of the clamping portion of the connection pin. The circular opening is provided in the spine at positions corresponding to the rotation means to accommodate the rotation means rotatably. The locking hole is provided in the spine at positions corresponding to the locking means to allow the insertion locking of the locking means.

BRIEF DESCRIPTION OF DRAWINGS

FIG. 1 fragmentarily enlarged perspective view illustrative of an example of the file the detachable metal binder according to the present invention, FIG. 2 is an enlarged cross sectional view illustrative of the connected state by means off connection pin of the file with the metal binder as shown in FIG. 1, FIG. 3 is a fragmentarily enlarged perspective view illustrative of the restriction means, provided in the bottom plate of the metal binder of the file with the metal binder as shown in FIG. 1, FIG. 4 is a fragmentarily enlarged perspective view illustrative of another example of the file with the detachable metal binder according to the present invention, FIG. 5 is a fragmentarily enlarged perspective view illustrative of the connected state by the connection pin of the file with the metal binder as shown in FIG. 4, FIG. 6 is a fragmentarily enlarged perspective view illustrative of a further example of the file with the detachable metal binder according to the present inventing.

BEST MODE FOR CARRYING OUT THE INVENTION

Figure 7:
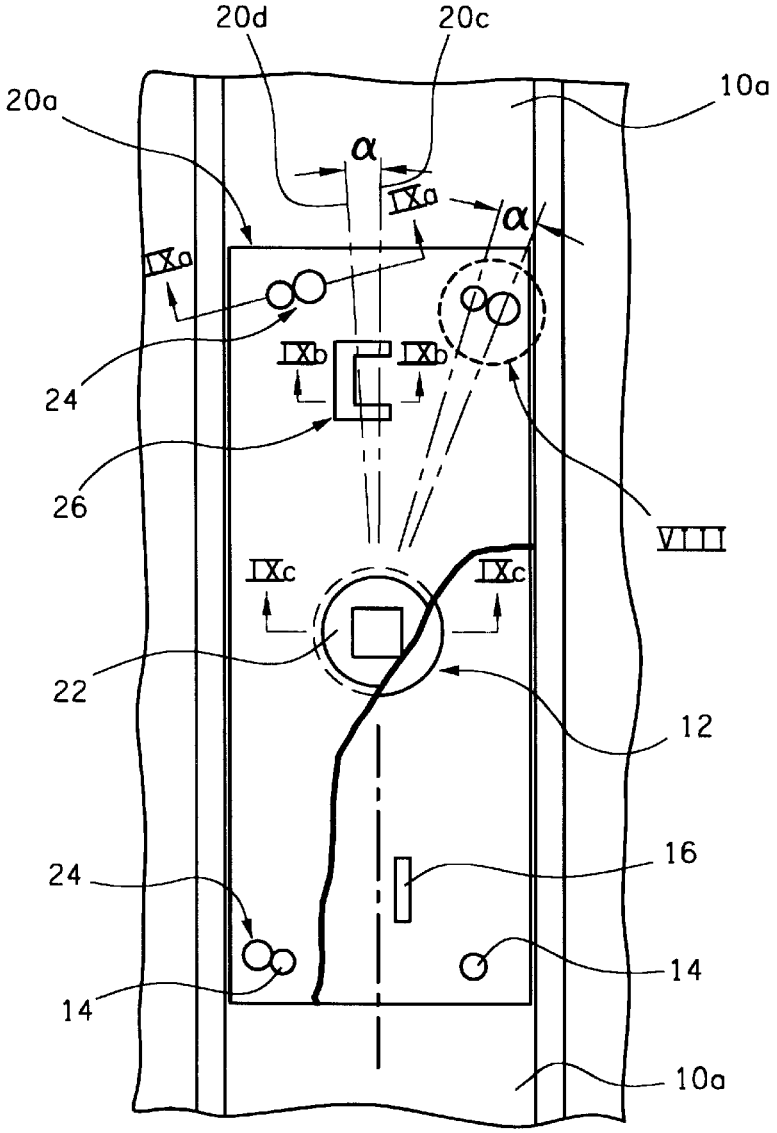
FIG. 7 is a partial sectional plane view illustrative of the locking position of the bottom plate of the metal binder of the file with the metal binder as shown in FIG. 6.

The detachable metal binder and the file with the detachable metal binder according to the present invention will be described on the examples with reference to the attached drawings.

FIG. 1 or FIG. 3 shows an example of the file with the detachable metal binder according to the present invention. Namely, it will be obvious that the file with the metal binder of the present example is, as described above (refer to FIG. 6), comprised of a cover 10, a metal binder 20 for attaching a bottom plate 20*a* in a spine 10*a* of the cover 10. It is also obvious that a reference numeral 10*b* of the drawings represents the front cover or the back cover, and a reference numeral 20*b* denotes the side plate.

In the file with the metal binder of the present example, the bottom plate 20*a* of the metal binder 20 comprises a restriction means 24 provided in each corner of the bottom plate, which includes a guide-opening 24*a* for confining the locking and the releasing operations of the connection pin 14 in two positions 24*b* and 24*c*. On the other hand, the spine 10*a* of the cover 10 provides a restriction opening 15 conforming to a position corresponding to the restriction means 24 on the bottom plate 20*a* of the metal binder 20.

In more details, as shown in FIGS. 2 and 3, the restriction means 24 provides at the opposite edges of the guide-opening 24*a* the locking hole portion 24*b* and the passing-through hole 24*c* for locking and releasing respectively operations of a clamping portion 14*c* which is projectedly formed through a shaft portion 14*b* on an opposite edge of an extended diameter head portion 14*a* of a connection pin 14, so that the connection pin 14 is guided between the holes 24*b* and 24*c* through a shaft portion 14*b* and the guide-opening 24*a*. Accordingly, in the state as shown in FIG. 2, the cover 10 and the metal binder 20 are connectedly fixed by the connection pin 14.

The guide-opening 24*a* is formed substantially in parallel to the side edge of the bottom plate 20*a*, and each locking hole portion 24*b* of the restriction means 24 is formed at a closer position to one of edge portions which are opposed each other in the bottom plate 20*a* than the passing-through hole 24*c* communicating with the locking hole portion 24*b*.

In the present example, the connection pin 14 is designed for locking the extended diameter head portion 14*a* in the restriction opening 15 provided in the spine 10*a* of the cover 10, and the opening diameter of the restriction opening 15 is made wider than the outer diameter of the clamping portion 14*c* of the connection pin 14 which passes through the passing-through hole 24*c* of the restriction means 24 provided in the bottom plate 20*a* of the metal binder 20.

By this design, according to the file with the metal binder of the present example, the metal binder 20 fixed on the cover 10 slides along the guide-opening 24*a* of the restriction means 24 in the direction in which the connection pin 14 locked by the restriction means is moved from the locking hole portion 24*b* towards the passing-through hole 24*c*, so that the clamping portion 14*c* of the connection pin 14 is removed from the passing-through hole 24*c* of the restriction means 24 as well as the restriction opening 15 of the cover 10. Accordingly, the cover 10 is separated from the metal binder 20, and as a result, the connection pin 14 may also be separated from the cover as well as the metal binder.

FIGS. 4 and 5 show another example of the file with the detachable metal binder according to the present invention as a modified example. For convenience in the description, the same referenced numerals as those of FIGS. 1 and 3 are given to the same structures as those of FIGS. 1 and 3, is omitted in the detailed description.

In the file with the metal binder of the present example, a restriction opening 17 provided on the spine 10*a* of the cover 10 is designed in the same as the restriction means 24 in the bottom plate 20*a* of the metal binder 20 and provided to conform to each corresponding position. Namely, the restriction opening 17 provided on the spine 10*a* of the cover 10 comprises a guide-opening 17*a* for confining the locking and the releasing operations of the connection pin 14 in two positions 17*b* and 17*c*, and at the opposite edges of the guide-opening 17*a*, the locking hole portion 17*b* and the passing-through hole 17*c* for locking and releasing respectively operations of the clamping portion 14*c* which is projectedly formed through the shaft portion 14*b* on the opposite edge of the head portion 14*a* of the connection pin 14, so that the connection pin 14 is guided between the holes 17*b* and 17*c* through the shaft portion 14*b* and the guide-opening 17*a*. Accordingly, in the state as shown in FIG. 5, the cover 10 and the metal binder 20 are connectedly fixed by the connection pin 14. The opening diameter of the passing-through hole 17*c* of the restriction opening 17 is made in relatively the same diameter as the passing-through hole 24*c* of the restriction means 24 provided on the bottom plate 20*a* of the metal binder 20.

The guide-opening 24*a* is formed substantially in parallel to the side edge of the bottom plate 20*a*, and each locking hole portion 24*b* of the restriction means 24 is formed at a closer position to one of edge portions which are opposed each other in the bottom plate 20*a* than the passing-through hole 24*c* communicating with the locking hole portion 24*b*.

By this design, according to the file with the metal binder of the present example, the metal binder 20 fixed on the cover 10 slides along the guide-opening 24*a* of the restriction means 24 in the direction in which the connection pin 14 locked by the restriction means is moved from the locking hole portion 24*b* towards the passing-through hole 24*c* and also towards the passing-through hole 17*c* of the restriction opening 17 provided in the cover 10, so that the clamping portion 14*c* of the connection pin 14 is removed from the passing-through hole 24*c* of the restriction means 24 as well as the passing-through hole 17*c* of the restriction opening 17 of the cover 10. Accordingly, the cover 10 is separated from the metal binder 20, and as a result, the connection pin 14 may also be separated from the cover 10 as well as the metal binder 20.

Figure 10:
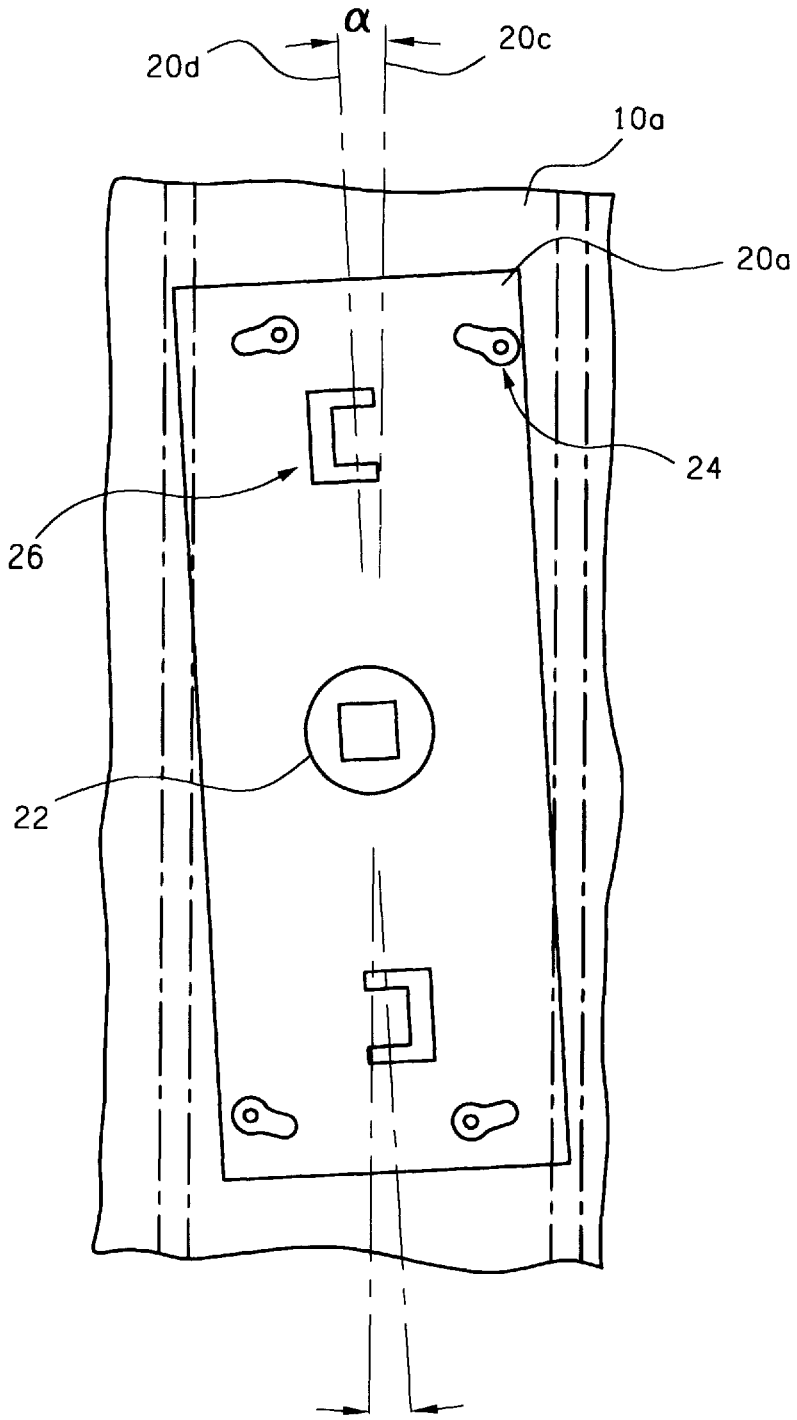
FIG. 10 is a plane view illustrative of the released state of the bottom plate of the metal binder of the file with the metal binder as shown in FIG. 6.

FIG. 6 or 10 shows another example of the file with the detachable metal binder according to the present invention. For convenience in the description, therefore, the same reference numerals as those of FIGS. 1 and 5 are given to the same structures as those of FIGS. 1 and 5, is omitted in the detailed description.

Namely, in the file with the detachable metal binder of the present example, the bottom plate 20*a* of the metal binder 20 comprises the rotation means 22 having a cylindrical face and provided in the center of the bottom plate 20*a* for rotating the bottom plate 20*a* between two positions of clamping and releasing (positions on the both central axis lines of 20*c* and 20*d* embracing rotating angle $\alpha$), the restriction means 24 provided in each corner of the bottom plate 20*a* and comprising the guide-opening 24*a* for confining the clamping and releasing operations in two positions

20*c* and 20*d*, and a locking means 26 having a hook for locking the bottom plate 20*a* in the locking position 20*c*, and provided between the rotation means 22 and the restriction means 24. On the other hand, the spine 10*a* of the cover 10 comprises the rotation means 22 on the bottom plate 20*a* of the metal binder 20, the restriction means 24, and a locking means 26, to corresponding portions of which the circular opening 12, the connection pin 14 having the extended diameter head portion, and a hook hole 16 are respectively conformed.

Figure 8:
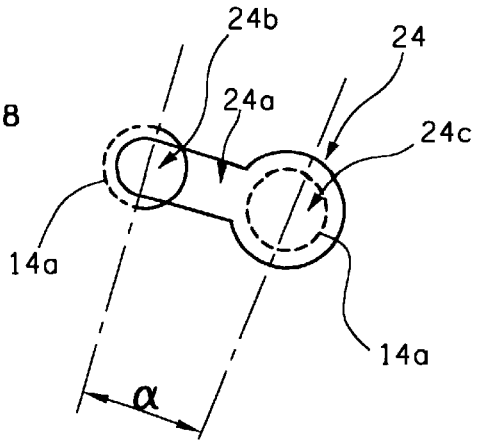
FIG. 8 is enlarged plane view of the part VIII of FIG. 2, FIG. 9(*a*) is a cross sectional view taken along IXa—IXa line of FIG. 7, FIG. 9(*b*) is a cross sectional view taken along IXb—IXb line of FIG. 7, and FIG. 9(*c*) is a cross sectional view taken along IXc—IXc line of FIG. 7.
Figure 9A:
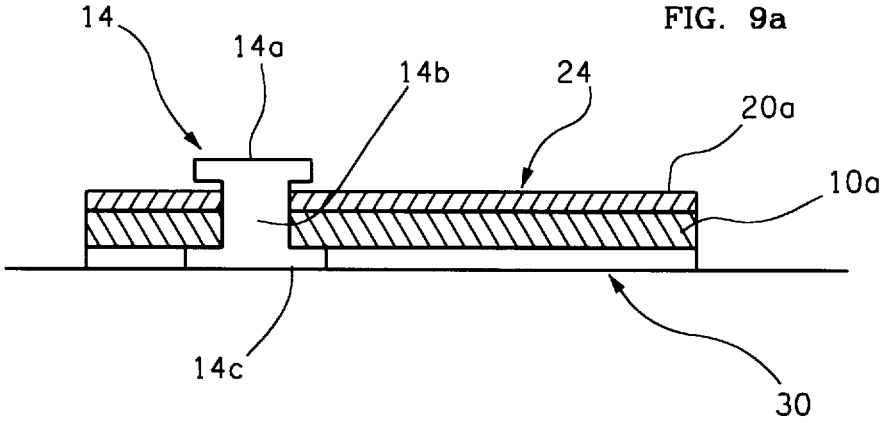
Figure 9B:
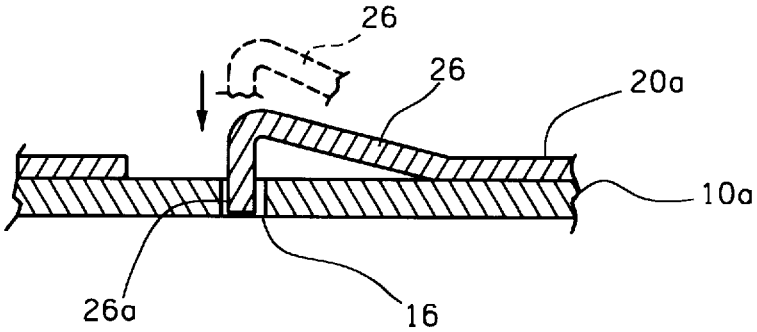
Figure 9C:
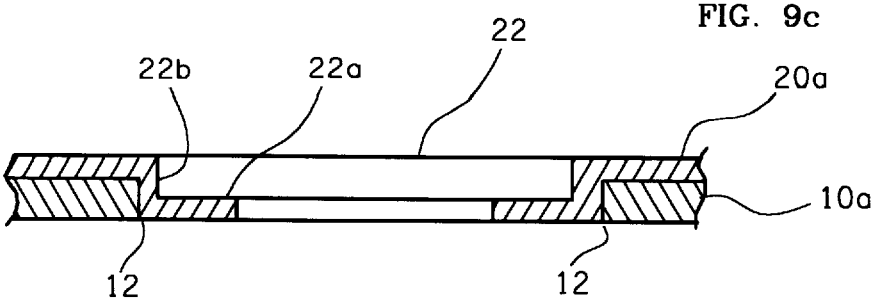

In more details, a rotation means 22 (particularly refer to FIG. 9 (*c*)) is formed with a cylindrical face 22*b* having the partially opened bottom plate 22*a*, and the cylindrical face 22*b* is formed to slidably contact with a circular opening 12 therein. The restriction means 24 (particularly refer to FIGS. 8 and 9 (*a*)) comprises at the opposite edges of the guide-opening 24*a* the locking hole portion 24*b* and the passing-through hole 24*c* for locking and releasing respectively operations of the clamping portion 14*c* which is projectedly formed through the shaft portion 14*b* on an opposite edge of the head portion 14*a* of the connection pin 14, so that the connection pin 14 is guided between the holes 24*b* and 24*c* through the shaft portion 14*b* and the guide-opening 24*a*.

When the bottom plate 20*a* is rotated by a certain angle from a position of the bottom plate 20*a*, in which the connection pin 14 is locked into the locking hole portion 24*b*, the guide-opening 24*a* allows a relative movement of the connection pin 14 and the bottom plate 20*a*, so that the passing-through hole 24*c* is able to accommodate the connection pin 14

The locking means 26 (particularly refer to FIG.9 (*b*)) is comprised of a locking piece 26*a* which is formed elastically, and in the locking position, the locking piece 26*a* is elastically locked into a locking hole 16. The rotation means 22, the restriction means 24, and the locking means 26 perform respectively an extruding process, a punching process, and a bending process for the bottom plate 20*a*.

Accordingly, the file with the metal binder of the present example thus designed is operated as follows.

At first, in FIG. 7, the metal binder 20 is arranged in the locking position 20*c* which is a coincident position of a central axis line of the bottom plate 20*a* and a central axis line of the spine 10*a* of the cover 10, so that, in this situation, a cylindrical face 22*a* of the rotation means 22 of the bottom plate 10*a*, the locking hole portion 24*b* of the restriction means 24, and the locking piece 26*a* of the locking means 26 are placed to be respectively locked into the circular opening 12 in the spine 10*a*, the extended diameter head portion 14*a* and the clamping portion 14*c* of the connection pin 14, and the hook hole 16, and as a result, the metal binder 20 is fixed in a predetermined position of the cover 10.

As shown in FIG. 10, in resisting to a constraining power of the locking means 26 or the locking power by the elasticity of the locking piece 26*a*, the metal binder 20 is rotated along the rotation means 22 by an angle $\alpha$ so as to be moved to the releasing position 20*d* from the locking position 20*c*. In this situation, in the bottom plate 20*a* of the metal binder 20, the locking of the extended diameter head portion 14*a* and the clamping portion 14*c* of the connection pin 14 is released through the passing-through hole 24*c* of the restriction means 24, so that the metal binder 20 is separated from the cover 10.

According to the file with the metal binder of this example, the file (disposal) is able to be separated into the cover (paper) and the metal binder (metal) when desired by a user. Therefore, it is possible to conveniently meet the requirement for recycling natural resources in the near future. An attachment of the metal binder 20 to the cover 10 is conveniently achieved by rotating the position from FIGS. 10 to 7 on a working table 30 (refer to FIG. 9(*a*)). In this separation, the connection pin 14 is to be further separated from the cover 10, however, the separation is relatively ready to work, since the cover is paper.

Thereas preferred examples of the present invention have hereinbefore been described, the present invention is not limited to such examples but possible to make various changes on design within the scope from which the spirit is not deviated. Further, the file with the metal binder of the present invention has advantages of relatively simple structures as well as easy operations.

As hereinbefore described, according to the detachable metal binder of the present invention, when the metal binder is attached to the spine of the cover by the connection pin, the metal binder is able to be separated from the cover by the transitting or the rotating movement in the predetermined direction.

Also, according to the file with the detachable metal binder of the present invention, the metal binder attached to the spine of the cover is able to be separated from the cover and the connection pin by the transitting or rotating movement in a predetermined direction.

INDUSTRIAL APPLICABILITY

Accordingly, the metal binder of the present invention is designed to be separated from the cover, and the file with the metal binder of the present invention allows the metal binder to be separated from the cover, so that the metal binder and the file with the metal binder of the present invention may readily meet the requirement for recycling natural resources. Further, the metal binder and the file with the metal binder have advantages of relatively simple structures as well as easy operations.

I claim:

1. A detachable metal binder in which a bottom plate is mounted on a spine of a cover by means of a connection pin is characterized by comprising:

a restriction means provided in each corner of said bottom plate providing a locking hole portion for locking a clamping portion of said connection pin, a passing-through hole through which said clamping portion is allowed to pass, and a guide-opening for establishing a communication between said passing-through hole and said locking hole and allowing the movement of a shaft portion of said connection pin that connects an extended diameter head portion and said clamping portion thereof, and said guide-opening being formed substantially in parallel to a side edge of said bottom plate, and each locking hole portion of said restriction means being formed at a closer position to one of edge portions which are opposed each other in said bottom plate than the passing-through hole communicating with said locking hole portion.

2. A detachable metal binder in which a bottom plate is mounted on a spine of a cover by means of a connection pin is characterized by comprising:

a rotation means provided in a center of said bottom plate to rotatably attach said metal binder into said spine, a restriction means provided in each corner of said bottom plate providing a locking hole portion for locking a clamping portion of said connection pin, a passing-through hole through which said clamping portion is allowed to pass, and a guide-opening for establishing a communication between said passing-through hole and said locking hole and allowing the movement of a shaft portion of said connection pin that connects an extended diameter head portion and said clamping portion thereof, a locking means in which the connection pin for locking said bottom plate in a locking position of said locking hole portion is respectively arranged between said restriction means on one edge of said bottom plate and said rotation means and between said restriction means on the opposite edge of said bottom plate and the rotation means, and said guide-opening allowing a relative movement of said connection pin and said bottom plate so that said passing-through hole is able to accommodate said connection pin when said bottom plate is rotated by a certain angle from said locking position.

3. A file with a detachable metal binder consisting of a cover and a metal binder attached in a spine of said cover is characterized by comprising:

a connection pin including a shaft portion, an extended diameter head portion formed in one edge of said shaft portion, and a clamping portion provided in the opposite edge of said shaft portion, a restriction means provided in each corner of the bottom plate of said metal binder and comprising a locking hole portion for locking a clamping portion of said connection pin, a passing-through hole through which said clamping portion is allowed to pass, and a guide-opening for establishing a communication between said passing-through hole and said locking hole portion and allowing the movement of a shaft portion of said connection pin, a restriction opening that allows the clamping portion of said connection pin to pass therethrough and is formed in said spine at positions corresponding to said restriction means, and said guide-opening being formed substantially in parallel to a side edge of said bottom plate, and each locking hole portion of said restriction means being formed at a closer position to one of edge portions which are opposed each other in said bottom plate than the passing-through hole communicating with said locking hole portion.

4. A file with a detachable metal binder consisting of a cover and a metal binder attached in a spine of said cover is characterized by comprising:

a connection pin providing a shaft portion, an extended diameter head portion formed in one edge of said shaft portion, and a clamping portion provided in connection pin of shaft portion, a restriction means provided in each corner of the bottom plate of said metal binder and comprising a locking hole portion for locking a clamping portion of said connection pin, a passing-through hole through which the clamping portion is allowed to pass, and a guide-opening for establishing a communication between said passing-through hole said the locking hole portion and allowing the movement of a shaft portion of said connection pin, a restriction opening being formed in substantially the same shape as said restriction means and provided in said spine at positions corresponding to said restriction means to enable said connection pin to be attached and detached to said spine, and said guide-opening being formed substantially in parallel to a side edge of said bottom plate, and each locking hole portion of said restriction means being formed at a closer position to one of edge portions which are opposed each other in said bottom plate than the passing-through hole communicating with said locking hole portion.

5. A file with a detachable metal binder consisting of a cover and a metal binder attached in a spine of said cover is characterized by comprising:

a connection pin including a shaft portion, an extended diameter head portion formed in one edge of said shaft portion, and a clamping portion provided in the opposite edge of said shaft portion, a rotation means provided in a center of the bottom plate of said metal binder to rotatably attach said metal binder into said spine, a restriction means provided in each corner of said bottom plate, and consisting of a locking hole portion for locking a clamping portion of said connection pin, a passing-through hole through which said clamping portion is allowed to pass, and a guide-opening for establishing a communication between said passing-through hole and said locking hole and allowing the movement of a shaft portion of said connection pin, a locking means in which said connection pin for locking said bottom plate in a locking position of said locking hole portion is respectively arranged between said restriction means on one edge of said bottom plate and said rotation means and between said restriction means on the opposite edge of said bottom plate and said rotation means, a restriction opening that allows a clamping portion of said connection pin to pass therethrough and is formed in said spine at positions corresponding to said locking hole portion in which said bottom plate is in the locking position, a circular opening for accommodating said rotation means rotatably and provided in said spine at positions corresponding to said rotation means, a locking hole for enabling an insertion locking of said locking means and provided in said spine at positions corresponding to said locking means, and said guide-opening allowing a relative movement of said connection pin and said bottom plate so that said passing-through hole is able to accommodate said connection pin when said bottom plate is rotated by a certain angle from said locking position.

6. The file with the detachable metal binder as claimed in claim 5, wherein said rotation means, said restriction means, and said locking means may possibly be formed respectively by an extruding process, an punching process, and an bending process for the bottom plate.

* * * * *

UNITED STATES PATENT AND TRADEMARK OFFICE

CERTIFICATE OF CORRECTION

PATENT NO. : 5,887,901

DATED : March 30, 1999

INVENTOR(S) : TOKUSIGE OHMIYA

It is certified that error appears in the above-identified patent and that said Letters Patent is hereby corrected as shown below:

Column 3, line 11, after "portion", insert --is--.

Column 4, line 42, change "off" to --of--.

Signed and Sealed this

Fourteenth Day of December, 1999

*Attest:*

Q. TODD DICKINSON

*Attesting Officer*

*Acting Commissioner of Patents and Trademarks*